US007677555B2

(12) United States Patent
Tanaka et al.

(10) Patent No.: US 7,677,555 B2
(45) Date of Patent: Mar. 16, 2010

(54) SHEET CONVEYING APPARATUS AND IMAGE FORMING APPARATUS WITH VIBRATION APPLYING UNIT

(75) Inventors: Mizuna Tanaka, Osaka (JP); Yasuo Matsuyama, Hyogo (JP); Hiroshi Fujiwara, Osaka (JP); Tomoyoshi Yamazaki, Osaka (JP); Toshikane Nishii, Osaka (JP); Kazuyoshi Kondo, Osaka (JP); Yasuhide Ohkubo, Osaka (JP); Haruyuki Honda, Osaka (JP); Ippei Kimura, Osaka (JP); Masafumi Takahira, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/314,966

(22) Filed: Dec. 19, 2008

(65) Prior Publication Data

US 2009/0174135 A1 Jul. 9, 2009

(30) Foreign Application Priority Data

Jan. 4, 2008 (JP) ..... 2008-000105

(51) Int. Cl.
*B65H 3/06* (2006.01)

(52) U.S. Cl. ..... 271/116; 271/114; 271/146

(58) Field of Classification Search ..... 271/10.13, 271/146, 114, 116, 115
See application file for complete search history.

(56) References Cited

U.S. PATENT DOCUMENTS 4,844,638 A * 7/1989 Kagami et al. ..... 400/636
5,219,154 A 6/1993 Fukube et al.
5,316,282 A 5/1994 Fukube et al.
5,322,269 A 6/1994 Fukube et al.
5,405,128 A 4/1995 Fujiwara et al.
7,448,611 B2 * 11/2008 Chang ..... 271/114
2005/0127592 A1 * 6/2005 Chang ..... 271/109
2007/0172255 A1 7/2007 Nanno et al.
2007/0273085 A1 11/2007 Nanno et al.
2008/0054554 A1 3/2008 Nishii et al.
2008/0143046 A1 6/2008 Nishii et al.
2008/0174065 A1 7/2008 Kita et al.
2008/0224385 A1 9/2008 Takahira et al.
2008/0237970 A1 10/2008 Tanaka et al.
2008/0273908 A1 11/2008 Ohkubo et al.
2008/0284090 A1 11/2008 Honda et al.

FOREIGN PATENT DOCUMENTS

JP 06016271 A * 1/1994
JP 2002-128323 5/2002
JP 2002128323 A * 5/2002
JP 2004002044 A * 1/2004
JP 2006-117405 5/2006
JP 2007-183352 7/2007
JP 2007183352 A * 7/2007

* cited by examiner

*Primary Examiner*—Patrick H Mackey
*Assistant Examiner*—Gerald W McClain
(74) *Attorney, Agent, or Firm*—Harness, Dickey & Pierce, P.L.C.

(57) ABSTRACT

A sheet conveying apparatus includes a sheet containing unit that contains sheets; a sheet conveying unit that conveys the sheets; a separating unit that separates a single sheet from the sheets; a holding unit that holds the separating unit; and a vibration applying unit that applies a vibration to any one of the sheets conveyed by the sheet conveying unit and the separating unit before starting conveyance of the sheets.

9 Claims, 3 Drawing Sheets

SHEET CONVEYING APPARATUS AND IMAGE FORMING APPARATUS WITH VIBRATION APPLYING UNIT

CROSS-REFERENCE TO RELATED APPLICATIONS

The present application claims priority to and incorporates by reference the entire contents of Japanese priority document 2008-000105 filed in Japan on Jan. 4, 2008.

BACKGROUND OF THE INVENTION

1. Field of the Invention

The present invention relates to a technology for conveying a printing sheet in an image forming apparatus.

2. Description of the Related Art

The final object of a typical image forming apparatus is to form a visible image on a printing sheet irrespective of whether the image forming apparatus employs the technique of electrophotography or ink-jet printing. For example, in an image forming apparatus that includes an automatic document feeder (ADF), the ADF feeds an original onto an original glass plate sheet by sheet, and an image reading unit reads an image of the original. After the image is read, the original is conveyed onto a document receiving tray of the ADF. On the other hand, a printing sheet stored in a paper feed unit of the image forming apparatus is conveyed to an image forming unit, where the image of the original is transferred and fixed onto the printing sheet, and then the printing sheet with the image formed on it is output. In these days, functions of the image forming apparatus have improved, and there is a need for increasing the speed of conveying printing sheets.

A typical paper feed unit includes a paper feed tray rotatably disposed so that a pressing unit such as a spring forces the topmost printing sheet in the paper feed tray toward a conveyance roller, and a separating unit separates one printing sheet from other printing sheets supplied by the conveyance roller from the paper feed tray. At this time, if a paper feed pressure applied by the paper feed tray on the topmost printing sheet is too high, the separating unit cannot separate one printing sheet, resulting in feeding of multiple printing sheets. On the contrary, if the paper feed pressure is too low, i.e. lower than a conveyance load of a paper feed guide or the like, the printing sheet is not supplied to the conveyance roller. In other words, it is necessary to set the paper feed pressure within a proper range.

Furthermore, to prevent a damage to the printing sheet and a misfeed due to an edge of the printing sheet being caught while it is conveyed from the paper feed unit to the separating unit, the printing sheets in the paper feed tray need to be near the separating unit or a paper feed guide unit of the paper feed unit, where the printing sheets may possibly contact the separating unit or the paper feed guide. Moreover, a guide unit that aligns a side and a tail of the printing sheets is provided to the paper feed unit to prevent the printing sheet from misalignment and skewing, and the guide unit also needs to physically contact the printing sheets. Sliding resistance by such physical contact causes a loss of the paper feed pressure. The proper range of the paper feed pressure needs to be determined in consideration of the loss. However, the amount of the loss is greatly affected by how a user feeds the printing sheets, and therefore the loss may be much larger than what is expected.

Technologies for reducing frequency of the misfeed by detecting a failure to convey the sheet and retrying to convey the sheet are disclosed in Japanese Patent Application Laid-open No. 2006-117405 and Japanese Patent Application Laid-open No. 2002-128323. However, because the printing sheet is conveyed again from the same point where the conveyance failed, and because static friction is higher than dynamic friction, there is even higher risk of a misfeed at the second time than the first time.

In another technology disclosed in Japanese Patent Application Laid-open No. 2007-183352, the frequency of the misfeed is reduced by intermittently conveying the printing sheets. However, because the force of conveyance after an interval needs to be higher than the static friction, there is also the risk of the misfeed.

SUMMARY OF THE INVENTION

It is an object of the present invention to at least partially solve the problems in the conventional technology.

According to an aspect of the present invention, there is provided a sheet conveying apparatus including a sheet containing unit that contains sheets; a sheet conveying unit that conveys the sheets; a separating unit that separates a single sheet from the sheets; a holding unit that holds the separating unit; and a vibration applying unit that applies a vibration to any one of the sheets conveyed by the sheet conveying unit and the separating unit before starting conveyance of the sheets.

According to another aspect of the present invention, there is provided an image forming apparatus including the above sheet conveying apparatus and an image forming unit that forms an image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to the embodiments, and various modifications can be made without departing from the scope of the invention.

Figure 1:
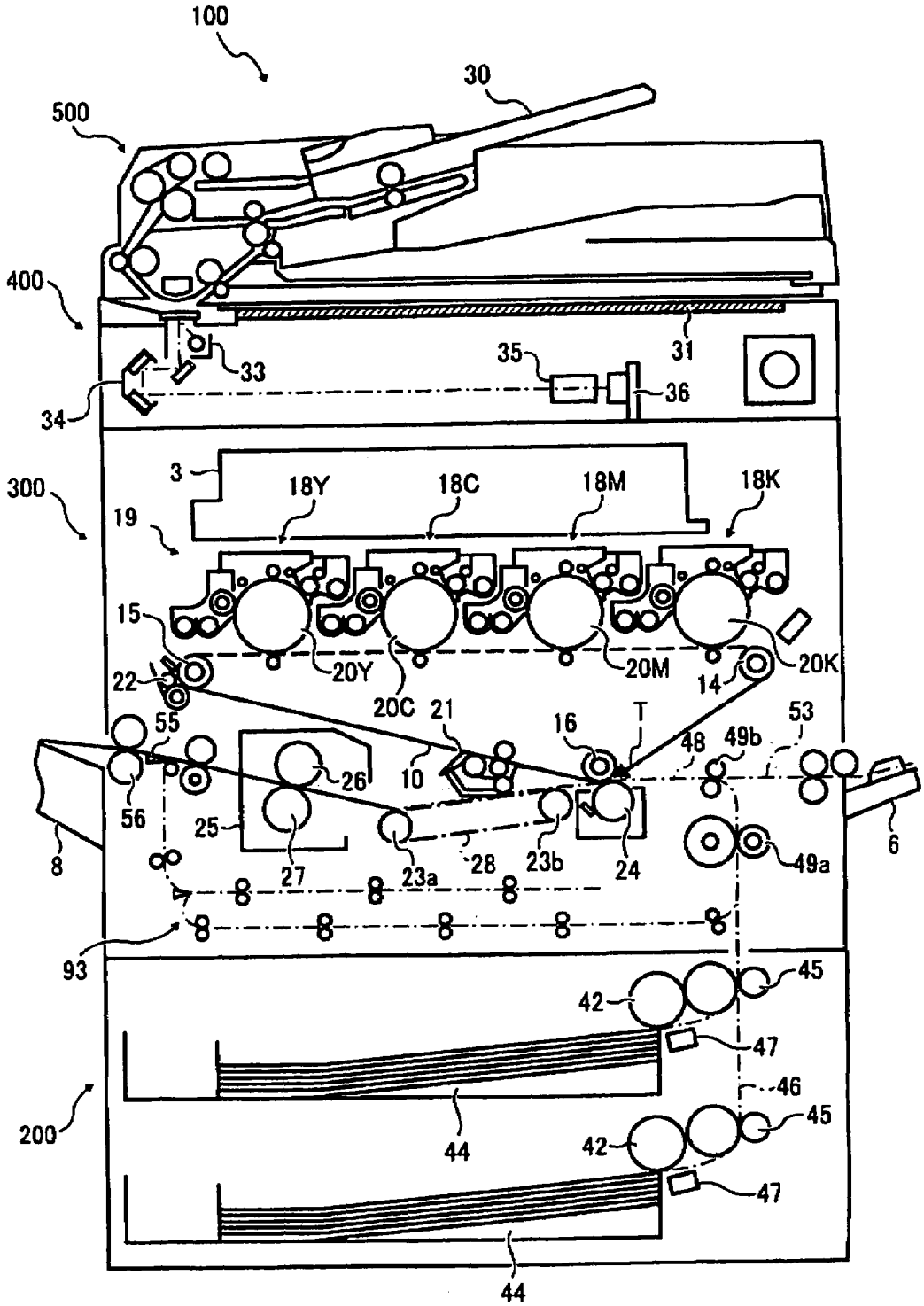
FIG. 1 is a schematic diagram of an image forming apparatus that includes a sheet separating unit according to a first embodiment of the present invention.

FIG. 1 is a schematic diagram of an image forming apparatus 100 that includes a sheet separating unit according to a first embodiment of the present invention. The image forming apparatus 100 includes a copying unit 300 that forms an image, a sheet conveying unit 200 provided under the copying unit 300, a scanner 400 provided above the copying unit 300, an automatic document feeder (ADF) 500 provided above the scanner 400.

The copying unit 300 includes an intermediate transfer belt 10 in the shape of an endless belt virtually at the center of the copying unit 300.

The intermediate transfer belt 10 is an intermediate transfer unit that holds a toner image. The intermediate transfer belt 10 is held by a first tension roller 14, a second tension roller 15, and a third tension roller 16 with a tension applied, so that the intermediate transfer belt 10 can rotate in a clockwise direction. On a part of the intermediate transfer belt 10 horizontally stretched between the first tension roller 14 and the second tension roller 15, four image forming units 18Y, 18M, 18C, and 18K corresponding to yellow, magenta, cyan, and black are arranged in the direction in which the intermediate transfer belt 10 rotates. The four image forming units 18Y, 18M, 18C, and 18K, thus constitute a tandem image forming unit 19.

The intermediate transfer belt 10 needs to have excellent mechanical characteristics to prevent misalignment caused by loosening of the belt. In the first embodiment, the intermediate transfer belt 10 is formed with a multilayer endless belt including a base layer made of a non-stretchy material such as fluororesin, physical vapor deposition (PVD) sheet, and polyimide resin, and a smooth coating with the fluororesin or the like on the base layer. The base layer includes resistance adjusting agent, such as carbon, dispersed in it, which keeps high transfer performance even when the temperature or the humidity of the ambient air changes, thereby constantly providing a high-quality image.

Provided between the second tension roller 15 and the third tension roller 16 is an intermediate-transfer-belt cleaning unit 21 that removes toner residue remaining on the intermediate transfer belt 10 after the image is transferred. A belt-lubricant applying unit 22 is provided on the downstream side of the intermediate-transfer-belt cleaning unit 21, and an exposure unit 3 is provided above the tandem image forming unit 19.

At a position opposing the third tension roller 16 that holds the intermediate transfer belt 10, a secondary transfer roller 24 that performs secondary transfer is provided so that the secondary transfer roller 24 can come into contact with and get away from the intermediate transfer belt 10. Alternatively, a transfer belt can be used to perform the secondary transfer. The toner image on the intermediate transfer belt 10 is transferred onto a printing sheet P shown in FIG. 2 by the secondary transfer roller 24 pressing against a part of the intermediate transfer belt 10 where the intermediate transfer belt 10 is wound around the third tension roller 16. A roller cleaning unit that cleans toner residue on the secondary transfer roller 24 can be provided in contact with the secondary transfer roller 24.

On the downstream side of the secondary transfer roller 24, a transfer belt 28, which is an endless belt, is provided around rollers 23*a* and 23*b*. A fixing unit 25 that fixes the toner image transferred onto the printing sheet P is provided next to the transfer belt 28. The fixing unit 25 includes a heat roller 26 and a pressure roller 27, pressed against each other.

At the left of the copying unit 300, a copy receiving tray 8 that receives the printing sheet P that has passed through the fixing unit 25. Below the transfer belt 28 and the fixing unit 25, a sheet reversing unit 93 that reverses the printing sheet P and discharges the printing sheet P toward the secondary transfer roller 24 again.

The sheet conveying unit 200 includes a plurality of paper feed cassettes 44 that stores therein the printing sheets P and a paper feed path 46, through which the sheet P is conveyed from the paper feed cassettes 44 toward the secondary transfer roller 24. The paper feed path 46 is connected to a conveyance path 48 on the downstream side.

The printing sheet P picked-up from one of the paper feed cassette 44 is conveyed to the copying unit 300 through the paper feed path 46, then fed to a secondary transfer portion T between the secondary transfer roller 24 and the intermediate transfer belt 10 and to the fixing unit 25 through the conveyance path 48, and finally discharged on the copy receiving tray 8. Registration rollers 49*a* and 49*b* and a discharge roller 56 are provided along the conveyance path 48. Before the discharge roller 56, a switching claw 55 is provided. The switching claw 55 switches the traveling direction of the printing sheet P that was conveyed through the conveyance path 48 to either direction of the copy receiving tray 8 or the sheet reversing unit 93.

At the right of the copying unit 300, a manual paper-feed tray 6 is provided to manually feed the printing sheet P. On the downstream side of the manual paper-feed tray 6, a manual paper-feed path 53 is provided.

The scanner 400 includes a first self-propelled unit 33 and a second self-propelled unit 34, each including a light source that illuminates an original and a mirror. To the right of the first self-propelled unit 33 and the second self-propelled unit 34, an imaging lens 35 and a read sensor 36 are provided. The first self-propelled unit 33 and the second self-propelled unit 34 reciprocate to scan the original. The imaging lens forms the image obtained by scanning the original on an imaging plane of the read sensor 36, so that the read sensor reads the image as image signals.

Figure 2:
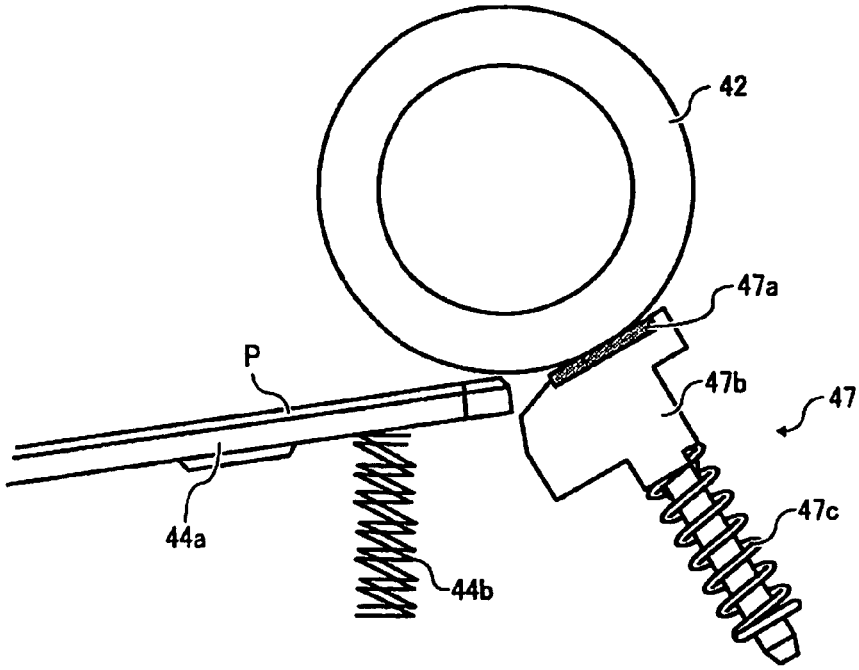
FIG. 2 is an enlarged view of a part of a sheet conveying unit shown in FIG. 1.

FIG. 2 is an enlarged view of a part of the sheet conveying unit 200. The sheet conveying unit 200 includes a sheet separating unit 47, a paper feed roller 42. The sheet separating unit 47 includes a friction member 47*a*, a holding member 47*b*, and a spring 47*c*.

The paper feed cassette 44 includes a paper feed plate 44*a* and a spring 44*b*. The printing sheets P on the paper feed plate 44*a* are forced against the paper feed roller 42 by the spring 44*b*. The paper feed plate 44*a* is rotatable, and it is always forced against the paper feed roller 42 no matter how many printing sheets P are placed on it. When the paper feed cassette 44 containing the printing sheets P is attached to the sheet conveying unit 200, the spring 44*b* in conjunction with the paper feed plate 44*a* raises the paper feed plate 44*a* until the top surface of the printing sheet P receives a sufficient pressure to be conveyed by the paper feed roller 42, and the paper feed plate 44*a* is controlled to stay at the position.

The paper feed roller 42 rotates in response to a signal from the image forming apparatus 100. When the paper feed roller 42 rotates on the top surface of the printing sheet P while applying a predetermined pressure to the printing sheet P, the printing sheet P is picked-up. At this time, the friction member 47*a*, which is a separation unit on the holding member 47*b*, is forced against the paper feed roller 42 by the pressure applied by the spring 47*c*. Therefore, when the printing sheet P is fed in a nip between the paper feed roller 42 and the friction member 47*a*, a predetermined frictional force is applied to the printing sheet P. If two or more printing sheets P are fed in the nip between the paper feed roller 42 and the friction member 47*a*, one printing sheet P among those printing sheets P is separated because of this frictional force. The higher the pressure (hereinafter, "paper feed pressure") applied by the spring 44*b* to feed the printing sheet P becomes, the more reliably the paper feed roller 42 can feed the printing sheet P, causing less misfeeds. However, at the same time, more printing sheets P are likely to be fed in the nip between the paper feed roller 42 and the friction member 47*a*. Therefore, it is required to determine the paper feed pressure that does not cause the misfeed and the multiple paper feed to various types of the printing sheets.

The paper feed roller 42 then rotates for a predetermined time that is sufficient enough to feed the printing sheet P to a conveyance roller 45 in the paper feed path 46 and then moves above to withdraw from the printing sheet P.

Figure 3:
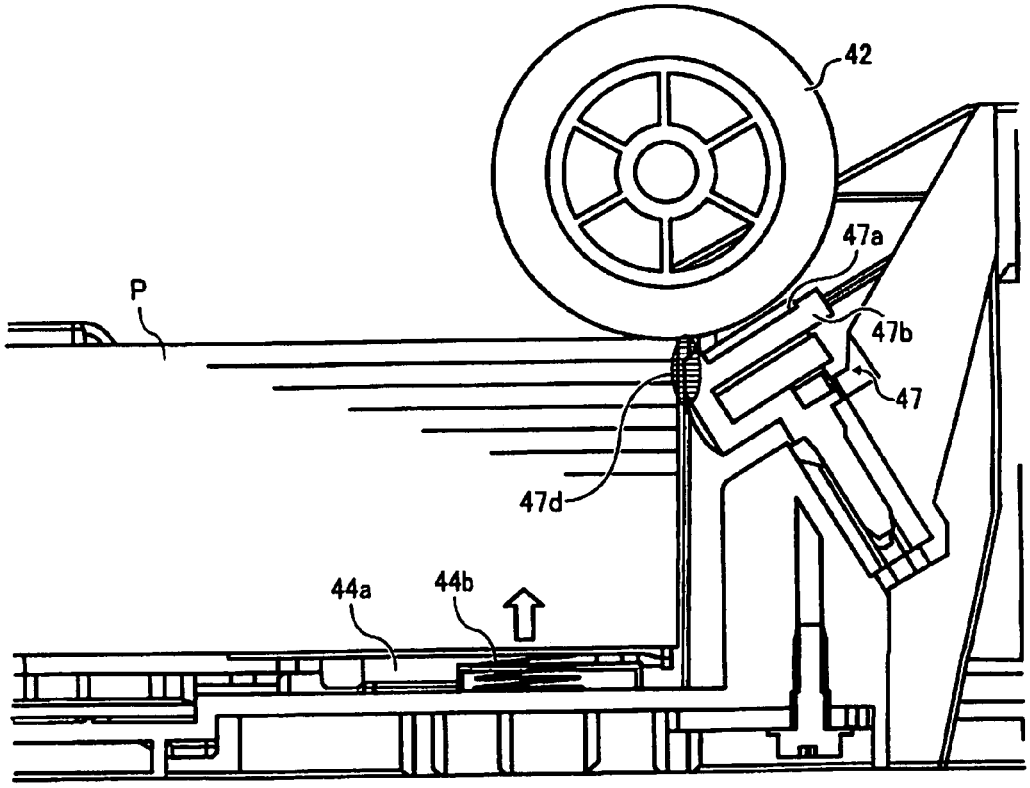
FIG. 3 is an enlarged view of a pressed portion between a paper feed roller and a friction member both shown in FIG. 1.

FIG. 3 is a schematic diagram of the nip between the paper feed roller 42 and the friction member 47*a*. A lump of printing sheets P is stacked on the paper feed plate 44*a*. To feed the topmost one of the printing sheets P, the holding member 47*b* needs to be close to the printing sheet P. If there is a gap between the holding member 47*b* and the printing sheet P, there are risks that an edge of the printing sheet P gets folded and the printing sheet P is misfeed. Therefore, when the printing sheets P are placed onto the paper feed plate 44*a*, an end of the printing sheets P comes into contact with a contact portion 47*d* of the holding member 47*b*. At the contact portion 47*d*, the holding member 47*b* contacts the printing sheets P, and slides to separate each of the printing sheets P, thereby preventing a plurality of the printing sheets P from being fed at a time. However, a loss of the paper feed pressure of the spring 44*b* is caused by the sliding motion. As a result, the spring 44*b* cannot apply the sufficient pressure to the paper feed roller 42, thereby causing the misfeed.

To prevent the loss of the paper feed pressure at the contact portion 47*d*, a vibration is applied via the paper feed roller 42. The paper feed roller 42 is turned on and off by turning an electromagnetic clutch (not shown) on and off. An impact is generated when the electromagnetic clutch is turned on. The impact is transferred to the paper feed roller 42. This impact functions as the vibration to prevent the loss of the paper feed pressure at the contact portion 47*d*.

Figure 4:
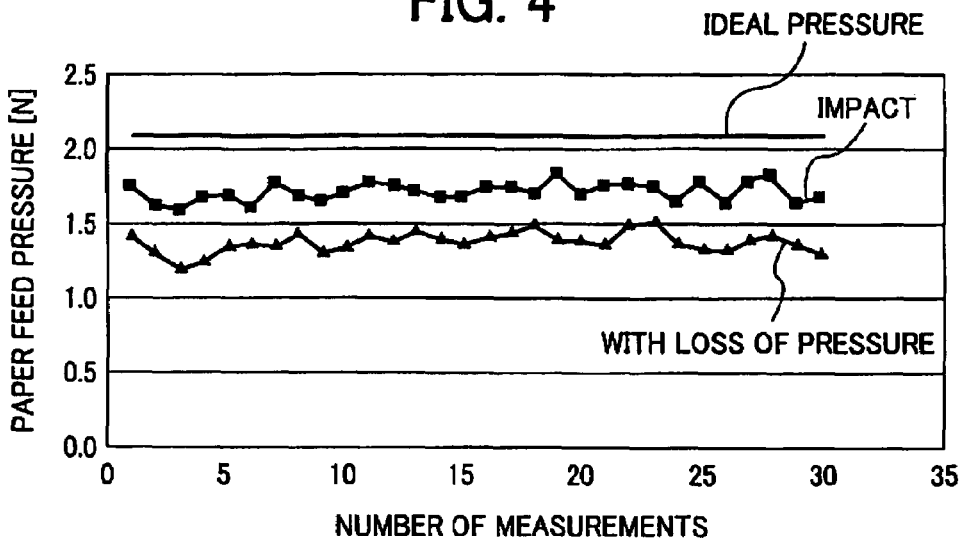
FIG. 4 is a chart of paper feed pressures applied to the paper feed roller.

FIG. 4 is a graph that explains how the paper feed pressure applied to the paper feed roller 42 changes with the number of measurements. The lateral axis indicates the number of measurement, and the measurement was performed 30 times. A straight line indicates an ideal paper feed pressure with which the paper feed roller 42 can reliably feed the printing sheets P. A curve titled "with loss of pressure" indicates the paper feed pressures when the sliding at the contact portion 47*d* causes the loss of the paper feed pressure. The impact means the paper feed pressure applied by the sheet conveying apparatus according to the present invention, and a curve titled "impact" indicates the paper feed pressures when a weak vibration is applied to the paper feed roller 42 by turning the electromagnetic clutch on and off at a level equivalent to the vibration when the clutch is engaged.

Figure 5:
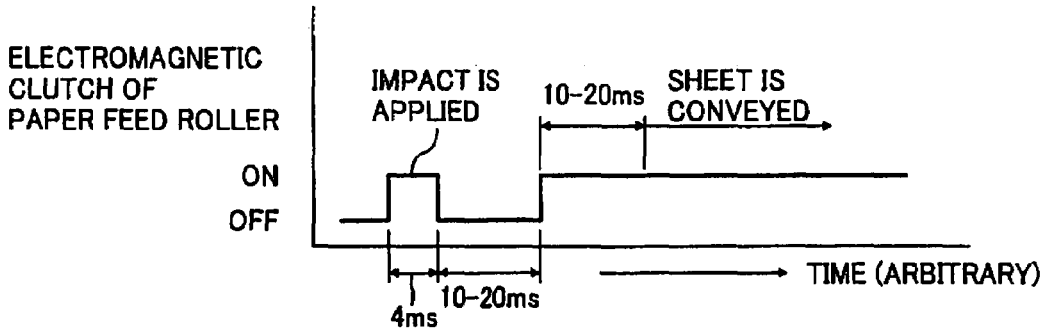
FIG. 5 is a schematic diagram for explaining timings of turning an electromagnetic clutch on and off in paper feed operation.

FIG. 5 is a schematic diagram for explaining timings of turning the electromagnetic clutch on and off in paper feed operation to perform the measurements shown in FIG. 4. The result shows that the paper feed pressure increases by about 0.3 Newtons [N] by applying the impact, though not to the ideal pressure. To make the paper feed pressure closer to the ideal paper feed pressure, it is preferable to increase the number of times of turning the electromagnetic clutch on and off.

Figure 6:
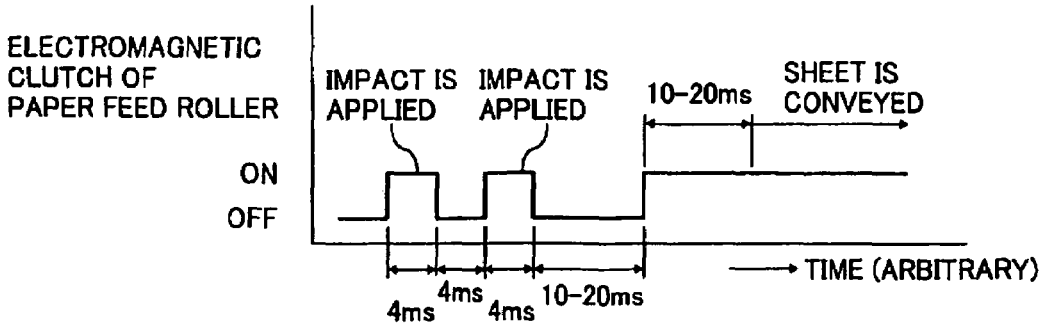
FIG. 6 is a schematic diagram for explaining timings of turning the electromagnetic clutch on and off in paper feed operation in consideration of the longevity of the electromagnetic clutch.

FIG. 6 is a schematic diagram for explaining timings of turning the electromagnetic clutch on and off in paper feed operation in consideration of the longevity of the electromagnetic clutch. According to the first embodiment, the vibration is applied two times for 4 milliseconds (ms) each by turning the electromagnetic clutch on and off before starting the paper feed operation. In this manner, the paper feed pressure is increased by applying the vibration without operating the paper feed roller 42. Furthermore, because the electromagnetic clutch that transfers a driving force to the paper feed unit is also used to apply the vibration, an additional component is not required.

A period between the time point of receiving a signal to engage the electromagnetic clutch (hereinafter, "receipt of engagement signal") and the time point of receiving a signal to disengage the electromagnetic clutch (hereinafter, "receipt of disengagement signal") is made shorter than a period between the receipt of the engagement signal and the time point when the driving force is transferred to the paper feed unit. Because the paper feed unit starts the paper feed operation after confirming the engagement of the electromagnetic clutch, a predetermined time is required to confirm the engagement. The impact can be applied by only engaging and disengaging the electromagnetic clutch based on the engagement signal and the disengagement signal. To efficiently form an image, the period between the receipt of the engagement signal and the receipt of the disengagement signal needs to be reduced. Therefore, it is preferable to engage and disengage the electromagnetic clutch within a minimum time in consideration of the operation of the electromagnetic clutch.

The number of times of applying the vibration with the electromagnetic clutch can be changed depending on the height or the weight of the printing sheets P stored on the paper feed plate 44*a*. This is because the contact pressure that the paper feed roller 42 applies to the printing sheets P changes as the height of the stacked printing sheets P changes. Because the pressure decreases as the height of the printing sheets P decreases, i.e., as the number of the printing sheets P decrease, the number of times of applying the impact is increased. The weight of the printing sheets P also represents the number of the printing sheets P. Periods of the time during which the impact is given, the interval between the impacts, and the time during which the driving force is transferred to the paper feed unit after the receipt of the engagement signal, are not limited to 4 ms or 10 ms to 20 ms shown in FIGS. 5 and 6. The height of the printing sheets P can be measured by a combination of a light emitting element and a photodetector using an emission and a reflection of a light.

Returning to FIG. 1, an operation of the image forming apparatus 100 is explained below. To make a copy of an original using the image forming apparatus 100, a user sets the original on an ADF tray 30 of the ADF 500, or opens the ADF 500, places the original on a platen glass 31 of the scanner 400, and closes the ADF 500, thereby fixing the original.

The user presses a start button (not shown). When the original is set on the ADF tray 30, the ADF 500 conveys the original onto the platen glass 31, and the scanner 400 starts driving the first self-propelled unit 33 and the second self-propelled unit 34. At this time, a beam emitted by the first self-propelled unit 33 is reflected by a surface of the original on the platen glass 31 and then by a mirror of the second self-propelled unit 34, and received by the read sensor 36 through the imaging lens 35, whereby the image of the original is read. At the same time, a drive motor (not shown) rotates one of the first tension roller 14, the second tension roller 15, and the third tension roller 16, thereby rotating the remaining two and the intermediate transfer belt 10 around them.

Furthermore, photoconductor drums 20Y, 20M, 20C, and 20K respectively included in the image forming units 18Y, 18M/18C, and 18K starts rotating. The exposure unit 3 then exposes the photoconductor drums 20Y, 20M, 20C, and 20K to write beams based on the image read by the read sensor 36, thereby forming respective latent images on the photoconductor drums 20Y, 20M, 20C, and 20K.

The latent images on the photoconductor drums 20Y, 20M, 20C, and 20K are made visible by developing units 61Y, 61M, 61C, and 61K, thereby forming toner images in yellow, magenta, cyan, and black. The toner images formed on the photoconductor drums in the corresponding colors are primarily transferred onto the intermediate transfer belt 10, as they are superposed, by applying a predetermined transfer bias voltage to primary transfer units 62Y, 62M, 62C, and 62K opposing the photoconductor drums 20Y, 20M, 20C, and 20K across the intermediate transfer belt 10, thereby forming a color image on the intermediate transfer belt 10.

On the other hand, when the user presses the start button, the sheet conveying unit 200 selectively rotates the paper feed roller 42, thereby feeding the printing sheets P from one of the paper feed cassettes 44. The sheet separating unit 47 separates a single printing sheet P to feed it into the paper feed path 46. The printing sheet P is conveyed to the conveyance path 48 in the copying unit 300, and stops at the resist roller 49*b*.

At this time, the impact is applied by the electromagnetic clutch based on a printing signal to form the image when the power of the image forming apparatus 100 is turned on. If the electromagnetic clutch is turned on without receiving the printing signal to form the image, the longevity of the electromagnetic clutch is reduced. Therefore, the electromagnetic clutch can be configured to apply the impact based on the printing signal received after confirming that the paper feed cassette 44 contains the printing sheet P. Otherwise, it can be configured to apply the impact based on the printing signal received after detecting a failure to feed the printing sheet P. In this manner, an unnecessary operation of turning the electromagnetic clutch on and off is prevented, thereby extending the longevity of the electromagnetic clutch.

Furthermore, the duration time of the vibration caused by the impact of the electromagnetic clutch being turned on and off should be shorter than the period between the receipt of the engagement signal and start the paper feed operation. Because the sheet conveying unit 200 starts the paper feed operation after confirming the engagement of the electromagnetic clutch, a predetermined time is required to confirm the engagement. The impact can be applied by only engaging and disengaging the electromagnetic clutch based on the engagement signal and the disengagement signal. To efficiently form the image, the period between the receipt of the engagement signal and the receipt of the disengagement signal needs to be reduced. Therefore, it is preferable to engage and disengage the electromagnetic clutch within a minimum time in consideration of the operation of the electromagnetic clutch.

At the right time when the color toner image formed on the intermediate transfer belt 10 is conveyed to the secondary transfer portion T where the secondary transfer roller 24 opposes the third tension roller 16, the resist roller 49*b* starts rotating, thereby conveying the printing sheet P to the secondary transfer portion T. At the secondary transfer portion T, the predetermined transfer bias voltage is applied to the secondary transfer roller 24 to secondarily transfer the color toner image from the intermediate transfer belt 10 to the printing sheet P.

The printing sheet P is conveyed to the fixing unit 25 in the state where the printing sheet P is adhering to the secondary transfer roller 24. The fixing unit 25 applies heat and pressure to the printing sheet P, thereby fixing the toner image on the printing sheet P. After fixing the toner image, the discharge roller 56 discharges the printing sheet P onto the copy receiving tray 8.

Alternatively, the switching claw 55 can switch the direction of conveyance to lead the printing sheet P to the sheet reversing unit 93, where the printing sheet P is reversed and lead to the secondary transfer portion T again. At the secondary transfer portion T, another image is formed on the back of the printing sheet P. The discharge roller 56 then discharges the printing sheet P onto the copy receiving tray 8.

The intermediate-transfer-belt cleaning unit 21 removes the toner residue remaining on the intermediate transfer belt 10 after the secondary transfer, providing for the next image forming process.

The toner removed by the intermediate-transfer-belt cleaning unit 21 is delivered to a waste toner bottle (not shown) via a waste toner path (not shown).

According to an aspect of the present invention, it is possible to reliably convey the printing sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming apparatus that forms an image on a sheet; and a sheet conveying apparatus that supplies a sheet to the image forming apparatus, the sheet conveying apparatus including a sheet containing unit that contains sheets;

a sheet conveying unit that conveys the sheets;

a separating unit that separates a single sheet from the sheets;

a holding unit that holds the separating unit; and a vibration applying unit that applies a vibration to any one of the sheets conveyed by the sheet conveying unit and the separating unit before starting conveyance of the sheets, wherein the vibration applying unit applies the vibration based on one of a printing signal received after a power of the image forming apparatus is turned on and a printing signal received after detecting that a sheet is contained in the sheet containing unit.

2. The image forming apparatus according to claim 1, wherein a period between start of the vibration and termination of the vibration is shorter than a period between an issue of a printing signal and a start of the conveyance.

3. A sheet conveying apparatus comprising:

a sheet containing unit that contains sheets;

a sheet conveying unit that conveys the sheets;

a separating unit that separates a single sheet from the sheets;

a holding unit that holds the separating unit; and a vibration applying unit that applies a vibration to any one of the sheets conveyed by the sheet conveying unit and the separating unit before starting conveyance of the sheets, wherein any one of an end of the sheets contained in the sheet containing unit and the sheet containing unit makes a physical contact with the holding unit at a contact portion, and the vibration applying unit applies the vibration at the contact portion.

4. The sheet conveying apparatus according to claim 1, wherein the vibration applying unit applies the vibration more than once.

5. The sheet conveying apparatus according to claim 1, wherein the vibration applying unit applies the vibration for number of times based on a height of a lump of the sheets contained in the sheet containing unit.

6. The sheet conveying apparatus according to claim 1, wherein the vibration applying unit applies the vibration for number of times based on a weight of a lump of the sheets contained in the sheet containing unit.

7. A sheet conveying apparatus comprising:

a sheet containing unit that contains sheets;

a sheet conveying unit that conveys the sheets;

a separating unit that separates a single sheet from the sheets;

a holding unit that holds the separating unit; and a vibration applying unit that applies a vibration to any one of the sheets conveyed by the sheet conveying unit and the separating unit before starting conveyance of the sheets wherein the vibration applying unit is an electromagnetic clutch that is coupled to the sheet conveying unit.

8. The sheet conveying apparatus according to claim 7, wherein a period between a first time point of receiving a first signal to couple the electromagnetic clutch to the sheet conveying unit and a second time point of receiving a second signal to decouple the electromagnetic clutch from the sheet conveying unit is shorter than a period between the first time point and a third time point when a driving force from the electromagnetic clutch arrives at the sheet conveying unit.

9. The sheet conveying apparatus according to claim 8, wherein a period between the first time point and the second time point is equal to or shorter than a minimum time in which the electromagnetic clutch can engage.

* * * * *